US009468325B2

(12) United States Patent
Davis

(10) Patent No.: US 9,468,325 B2
(45) Date of Patent: Oct. 18, 2016

(54) UNIFORM ORGANIZER

(71) Applicant: Dimitri Davis, Stonewall, MS (US)

(72) Inventor: Dimitri Davis, Stonewall, MS (US)

( * ) Notice: Subject to any disclaimer, the term of this patent is extended or adjusted under 35 U.S.C. 154(b) by 27 days.

(21) Appl. No.: 14/686,477

(22) Filed: Apr. 14, 2015

(65) Prior Publication Data

US 2015/0335188 A1 Nov. 26, 2015

Related U.S. Application Data

(60) Provisional application No. 62/002,444, filed on May 23, 2014.

(51) Int. Cl.

| | |
|---|---|
| ***A47G 25/28*** | (2006.01) |
| ***A47G 25/44*** | (2006.01) |
| ***A44C 3/00*** | (2006.01) |
| ***A41D 29/00*** | (2006.01) |

(52) U.S. Cl.

CPC ..... *A47G 25/28* (2013.01); *A41D 29/00* (2013.01); *A44C 3/001* (2013.01); *A47G 25/44* (2013.01); *A47G 25/442* (2013.01); *A47G 25/447* (2013.01)

(58) Field of Classification Search

CPC .... A47G 25/28; A47G 25/44; A47G 25/442; A47G 25/447; A47G 25/1407; A47G 44/4053; A47G 25/4046; A47G 25/4061; A47G 1/02; A44C 3/001; A44C 3/004; A41H 3/00; B25H 7/00

USPC ..... D10/64

See application file for complete search history.

(56) References Cited

U.S. PATENT DOCUMENTS

| | | | | | |
|---|---|---|---|---|---|
| 2,387,986 | A * | 10/1945 | Evans | A41H 1/02 | 33/653 |
| 2,929,538 | A * | 3/1960 | Douglass | A47G 25/20 | 223/69 |
| 3,376,651 | A * | 4/1968 | Carey | A44C 3/001 | 33/653 |
| 3,645,426 | A * | 2/1972 | Glascock | A47G 25/447 | 223/89 |
| 3,942,273 | A | 3/1976 | Adams | | |
| 4,302,884 | A | 12/1981 | Pallone | | |
| 4,770,216 | A * | 9/1988 | Ruscak | B23Q 9/0042 | 144/144.1 |
| 5,782,022 | A | 7/1998 | Tubberville | | |
| 6,122,805 | A | 9/2000 | Haegley | | |
| 6,216,617 | B1 * | 4/2001 | Burt, Jr. | D05C 9/04 | 112/103 |
| 6,311,408 | B1 * | 11/2001 | Madayag | A41D 27/20 | 33/1 G |
| 7,527,004 | B1 * | 5/2009 | White | D05B 39/00 | 112/103 |
| 7,587,839 | B1 * | 9/2009 | Winter | A44C 3/002 | 33/653 |
| 7,963,004 | B2 | 6/2011 | Cho | | |
| 8,640,366 | B1 | 2/2014 | Solberg | | |
| 2010/0122469 | A1 * | 5/2010 | Allen | B25H 7/02 | 33/653 |

* cited by examiner

*Primary Examiner* — Ismael Izaguirre
(74) *Attorney, Agent, or Firm* — IDP Patent Services; Olav M. Underdal

(57) ABSTRACT

A uniform organizer for indicating correct placement of insignia and badges on a uniform jacket, includes an organizer frame, including a frame hook, a right and left upper frame sections with right and left collar markers, right and left side sections, and a bottom section; a name plate guide with a name cutout; a badge plate guide with a badge cutout, right and left vertical strips, a spacer, a leveling device, such that the uniform organizer can expand and retract as needed, and be configured for use with various types of uniforms from different military branches.

21 Claims, 5 Drawing Sheets

Uniform Organizer

Uniform Organizer

Name Plate

Frame Hook

Badge Plate Piece

UNIFORM ORGANIZER

CROSS-REFERENCE TO RELATED APPLICATIONS

This application claims benefit of U.S. Provisional Application No. 62/002,444 filed May 23, 2014.

FIELD OF THE INVENTION

The present invention relates generally to methods for ensuring correct organization of uniforms, and more particularly to devices, methods and systems for positioning insignia, ribbons, and other accoutrements on military uniforms.

BACKGROUND OF THE INVENTION

Strict standards must be adhered to when in the armed forces. Military uniforms must be straight, neat, and kept in a specific and orderly fashion. The slightest dishevelment can result in reprimands and punishment. Further, many military uniforms are to be worn with various insignia and other accessories for which it can be difficult to determine suitable placement and alignment.

There exists a need for a uniform organizer apparatus that allows one to hang garments and other accessories thereon. Devices are known that relate to apparatuses for holding military uniforms, wherein one device relates to a holder for military tags, badges, and metals. Other devices relate to a hanger having a hook and a clamp member for holding garments. These devices however, do not utilize cutout areas or a leveling device.

As such, considering the foregoing, it may be appreciated that there continues to be a need for novel and improved devices and methods for positioning of insignia on military uniforms.

SUMMARY OF THE INVENTION

The foregoing needs are met, to a great extent, by the present invention, wherein in aspects of this invention, enhancements are provided to the existing models of organizers or templates for positioning insignia on a military uniform.

Various aspects of the present invention provides a uniform organizer apparatus that allows a service member to maintain a neat and straight uniform.

In related aspects, the uniform organizer can help a service member to adhere to strict military dress standards and pass a uniform inspection thereof.

In other related aspects, the uniform organizer can provide cutouts and a leveling device in order to ensure an organized uniform placement.

In yet other related aspects, the uniform organizer can provide location indication for accoutrements and other insignia to be pinned, hung and/or placed on a uniform.

In various aspects, the uniform organizer can be configured in for use with uniform layouts for specific branches of the military.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Figure 1:
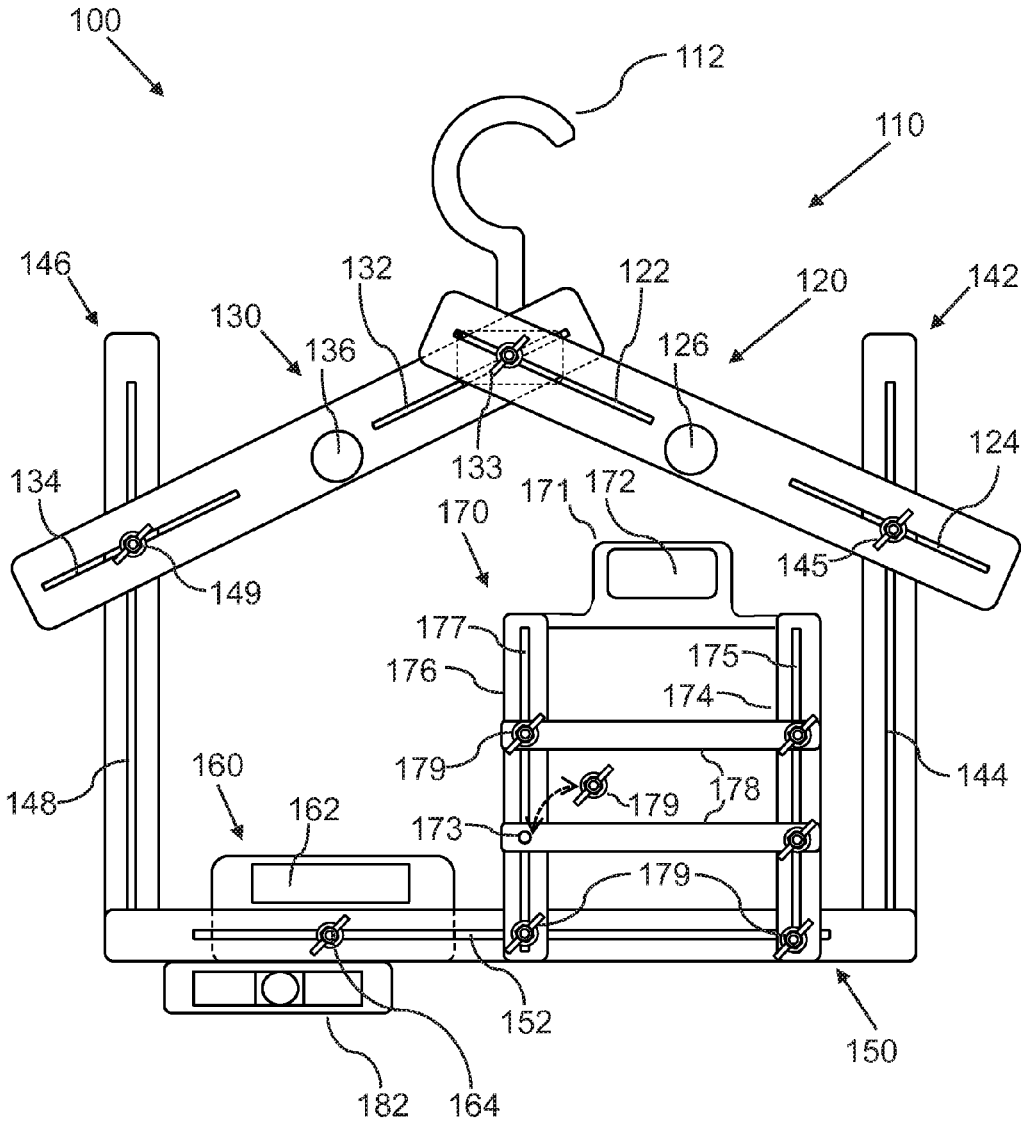
FIG. 1 is a front view of a uniform organizer, according to an embodiment of the invention.

In the following, we describe the structure of an embodiment of a uniform organizer 100 with reference to FIG. 1, in such manner that like reference numerals refer to like components throughout; a convention that we shall employ for the remainder of this specification.

Figure 4:
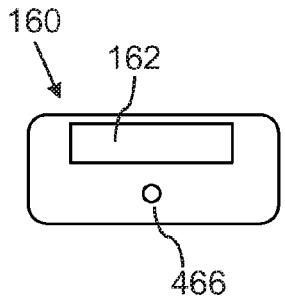
FIG. 4 is a front view of a name plate guide, according to an embodiment of the invention.
Figure 5:
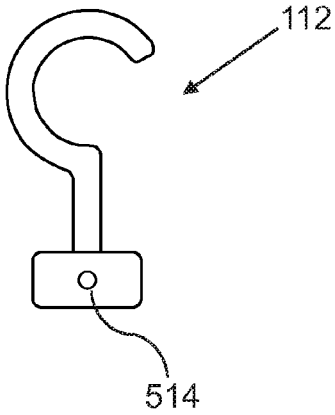
FIG. 5 is a front view of a frame hook, according to an embodiment of the invention.

In an embodiment, a uniform organizer 100 can include:

a) an organizer frame 110, which can include:

i. A frame hook 112, which can further include:

1. a mounting hole 514, shown in FIG. 5, in a lower end of the frame hook 112.

ii. A right upper frame section 120, which is an elongated piece, which can include:

1. A right inner slit 122, which is an elongated aperture in an inner end of the right upper frame section 120, such that the right upper frame section 120 can be slidably and rotationally attached to the frame hook 112, such that the right upper frame section 120 can be secured in a selected position with a top fastening mechanism 133, such as a bolt and wingnut, such that the bolt is inserted through the frame hook mounting hole 514 and the right inner slit 122;
2. A right outer slit 124, which is an elongated aperture in an outer end of the right upper frame section 120;
3. A right collar marker 126, which is a circular aperture in a central part of the right upper frame section;

iii. A left upper frame section 130, which is an elongated piece, which can include:

1. A left inner slit 132, which is an elongated aperture in an inner end of the left upper frame section 130, such that the left upper frame section 130 can be slidably and rotationally attached to the frame hook 112, such that the left upper frame section 130 can be secured in a selected position with the top fastening mechanism 133, such as a bolt and wingnut, such that the bolt is inserted through the frame hook mounting hole 514 and the left inner slit 132;
2. A left outer slit 134, which is an elongated aperture in an outer end of the left upper frame section 130;
3. A left collar marker 136, which is a circular aperture in a central part of the left upper frame section;

iv. A right side section 142, which is an elongated piece, further including:

1. A right side slit 144, which is an elongated aperture along a central part of the right side section 142, configured such that the right side section 142 can be slidably and rotationally attached to the right upper frame section 120, such that the right side section 142 can be secured in a selected position with a right side fastening mechanism 145, for example with a bolt and wingnut, such that the bolt is inserted through the right outer slit 124 and the right side slit 144, such that the right side slit 144 can be secured in position with the wingnut tightened on the bolt;

v. A left side section 146; which is an elongated piece, further including:

1. A left side slit 148, which is an elongated aperture along a central part of the left side section 146, configured such that the left side section 146 can be slidably and rotationally attached to the left upper frame section 130, such that the left side section 146 can be secured in a selected position with a left side fastening mechanism 149, such as a bolt and wingnut, such that the bolt is inserted through the left outer slit 134 and the left side slit 148, such that the left side slit 148 can be secured in position with the wingnut tightened on the bolt;

vi. A bottom section 150, which is an elongated piece with straight edges, such that a right end of bottom section 150 is perpendicularly connected to a lower end of the right side section 142, and such that a left end of the bottom section 150 is perpendicularly connected to a lower end of the left side section 146; the bottom section 150 further comprising:

1. A bottom slit 152, which is an elongated aperture along a central part of the bottom section 150;

b) a name plate guide 160, which is horizontally slidably attached to a left side of the bottom section 150 with a name plate fastening mechanism 164, such as a bolt and wingnut, such that the bolt is inserted through a name plate aperture 466, shown in FIG. 4, in the name plate guide 160 and the bottom slit 152, such that the name plate guide 160, can further include:

i. a name cutout 162, to indicate the correct placement of a name tag;

c) a badge plate guide 170, which can further include:

i. a badge plate piece 171, including 1. a badge cutout 172, configured such that the badge cutout indicates a correct placement of a badge on the uniform jacket;

ii. right and left vertical strips 174 176, which are mounted on a right and left side of the badge plate piece 171 and protruding vertically downward, such that the right and left vertical strips 174 176, comprise respectively right and left vertical slits 175 177; and iii. optionally, at least one spacer 178, comprising right and left spacer apertures 173, wherein each spacer 178 is vertically slidably connected between the right and left vertical strips 174 176, and can be secured in place with spacer fastening mechanisms 179, such as bolt and wingnuts, such that the bolts are fastened through the right and left spacer apertures 173 and respectively the right and left vertical slits 175 177, in order to be positioned to indicate correct placement of ribbons and badges;

wherein upper ends of the right and left vertical strips 174 176 are connected to respectively right and left sides of the badge plate piece 171, such that the right and left vertical strips protrude vertically downward, wherein the right and left vertical strips are vertically slidably and horizontally slidably connected to the bottom section with right and left plate guide fastening mechanisms 179, such as a bolts and wingnuts, such that the right and left bolts are inserted through respectively the right and left vertical slits 175 177; and the bottom slit 152.

In related embodiments, for setup and sizing of the uniform organizer 100, the uniform organizer 100 can be assembled with fastening mechanisms attached, but loose, such that for example all wingnuts 704 are mounted on the respective bolts 702, in a loose connection, but are not tightened, such that all connected parts can slide and/or rotate relative to each other. Once the proper setup has been established all the fastening mechanisms can be tightened, whereby the uniform organizer 100 is configured for general use.

Figure 7:
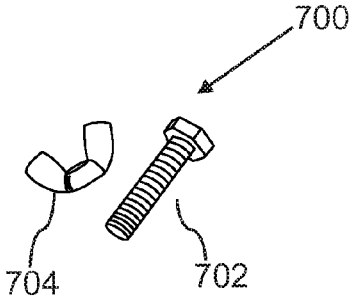
FIG. 7 is a perspective view of a fastening mechanism, in a configuration as a bolt and wingnut, according to an embodiment of the invention.

In various related embodiments, fastening mechanisms 133 145 149 164 179 can include bolt 702 and wingnut 704 fastening mechanisms 700, such as shown in FIG. 7, but can also include other types of bolts and nuts, or snap lock connectors, which allow disconnection, loose connection, and a tightened fastening.

In various related embodiments, the fastening mechanism 133 145 149 164 179 can allow a slidable connection, which can include a vertically slidable, a horizontally slidable, and/or a rotationally slidable connection, such that the fastening mechanism 133 145 149 164 179 can be connected through one or more slits or apertures, and can slide when in an attached loose configuration, for example such that a bolt protrudes through the slits or apertures, and a nut is loosely attached onto the bolt, such that it is held in place, but still allows movement along the slit, or rotating in an aperture, and such that the fastening mechanism 133 145 149 164 179 can be secured in place by tightening the nut.

In a related embodiment, the frame hook 112, can further include:

a. A pin attached to a lower end of the frame hook, such that the pin protrudes horizontally to the front of the frame hook 112;

b. A wing nut, which can be screwed on to an outer threaded end of the pin;

Such that the right and left upper frame sections 120 130 can be attached on the frame hook 112, by inserting the pin through the right and left inner slits 122 132 and screwing the wing nut in place on the outer end of the pin, such that the right and left upper frame sections 120 130 are secured in place.

In a related embodiment, the right and left upper frame sections 120 130, the right and left side sections 142 146, and the bottom section 150 can be made of elongated metal strips, with interior apertures.

In a related embodiment, the name plate guide 160, and the badge plate guide 170 can be made of plate metal with interior apertures. In general, the entire uniform organizer 100 can be made of a suitable strong metal or metal alloy, such as stainless steel or an aluminum alloy.

The uniform organizer provides a garment hanging and accessory placement apparatus that can be used for military dress uniforms and other garments wherein the uniform organizer can be pinned in place to a military jacket and the like.

In various embodiments, the uniform organizer 100 can be configured to correspond with the unique uniform of different branches of the military.

In a related embodiment, the uniform organizer 100 can further include a leveling device 182 located at the base of the uniform organizer in order to enable a user to confirm whether or not a uniform jacket is straight and leveled. As shown in FIG. 1 the leveling device can be connected to a lower edge of the bottom section 150. As shown, the leveling device 182 can be a bubble leveling device, or it can be electronic, or use some other leveling function.

In a related embodiment, the uniform organizer 100 provides spacers 178 that can be movable and thus can be adjusted in order to enable a user to accommodate and properly organize various items.

In a related embodiment, the uniform organizer 100 can be used for service members to properly hang and store their dress uniforms, and can be used with the jacket of a uniform wherein the uniform organizer can be configured in accordance with strict military regulations.

In a related embodiment, the uniform organizer 100 can expand and retract as needed and can provide a frame hook 112 located on the top area thereof.

In a related embodiment, the bottom section 150 of the frame 110 of the uniform organizer 100 can be configured such that a lower edge of the bottom section 150 can align with the top area of the pocket of a jacket placed thereon in order to allow the placement of military ribbons on the right hand side of the uniform organizer, with guidance from a spacer 178 in the badge plate guide 170.

Figure 2:
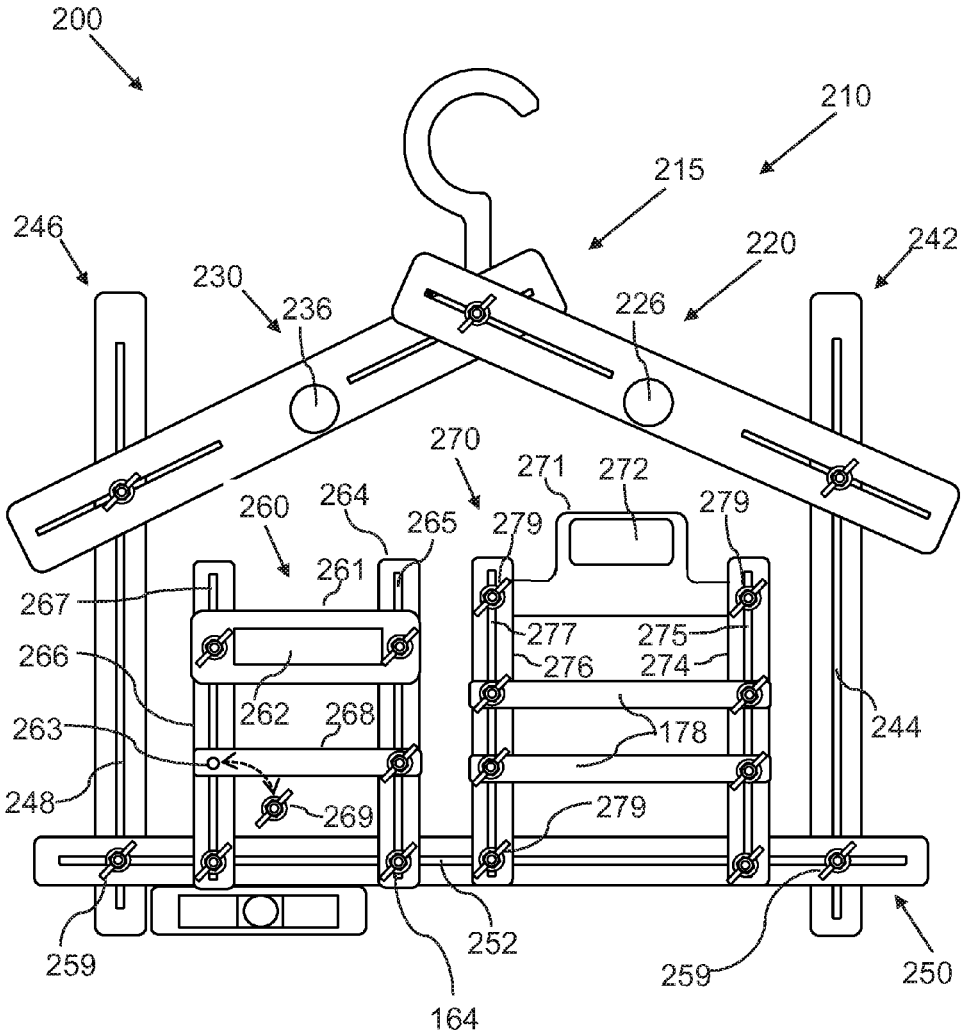
FIG. 2 is a front view of a uniform organizer, according to an embodiment of the invention.
Figure 6:
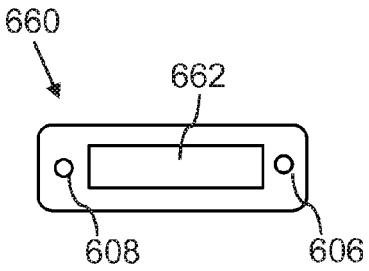
FIG. 6 is a front view of a name plate piece, according to an embodiment of the invention.

In a related embodiment, as shown in FIG. 2, an uniform organizer 200, can include alternative configurations, such that:

a. a name plate guide 260, can include:

i. a name plate piece 261, including 1. a name cutout 262, configured such that the name cutout 262 indicates a correct placement of a name plate on the uniform jacket;

ii. right and left vertical strips 264 266, which are mounted on a right and left side of the name plate piece 261 and protruding vertically downward, wherein the right and left vertical strips 264 266, comprise respectively right and left vertical slits 265 267; and iii. optionally, at least one spacer 268, comprising right and left spacer apertures 263, wherein each spacer 268 is vertically slidably connected between the right and left vertical strips 264 266, and can be secured in place with spacer fastening mechanisms 269, such as bolt and wingnuts, such that the bolts are fastened through the right and left spacer apertures 263 and respectively the right and left vertical slits 265 267, in order to be positioned to indicate correct placement of ribbons and badges;

wherein upper ends of the right and left vertical strips 264 266 are vertically slidably connected to respectively right and left sides of the name plate piece 261 with right and left plate piece fastening mechanisms 269, connected through right and left name plate apertures 606 608, shown in FIG. 6, and respectively the right and left vertical slits 265 267, in order to be positioned to indicate correct placement of ribbons and badges, such that the right and left vertical strips protrude vertically downward;

wherein the right and left vertical strips are vertically slidably and horizontally slidably connected to the bottom section with right and left name guide fastening mechanisms 269, such as a bolts and wingnuts, such that the right and left bolts are inserted through respectively the right and left vertical slits 265 267; and the bottom slit 252.

Figure 8:
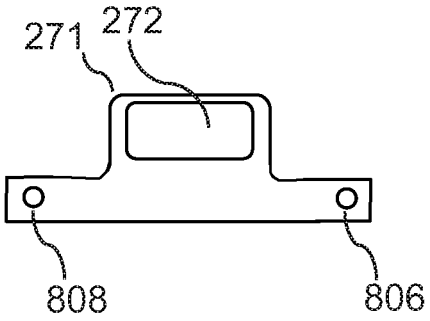
FIG. 8 is a front view of a badge plate piece, according to an embodiment of the invention.

In a related embodiment, as shown in FIG. 2, the badge plate guide 270 can be configured such that upper ends of the right and left vertical strips 274 276 are vertically slidably connected to respectively right and left sides of the badge plate piece 271 with right and left plate piece fastening mechanisms 279, connected through right and left badge plate apertures 806 808, shown in FIG. 8, and respectively the right and left vertical slits 275 277.

In a related embodiment, as shown in FIG. 2, the bottom section 250 can be vertically slidably and horizontally slidably connected to the right and left side sections 242 246 with right and left name guide fastening mechanisms 259, connected through respectively the right and left vertical slits 244 248 and the bottom slit 252.

Figure 3:
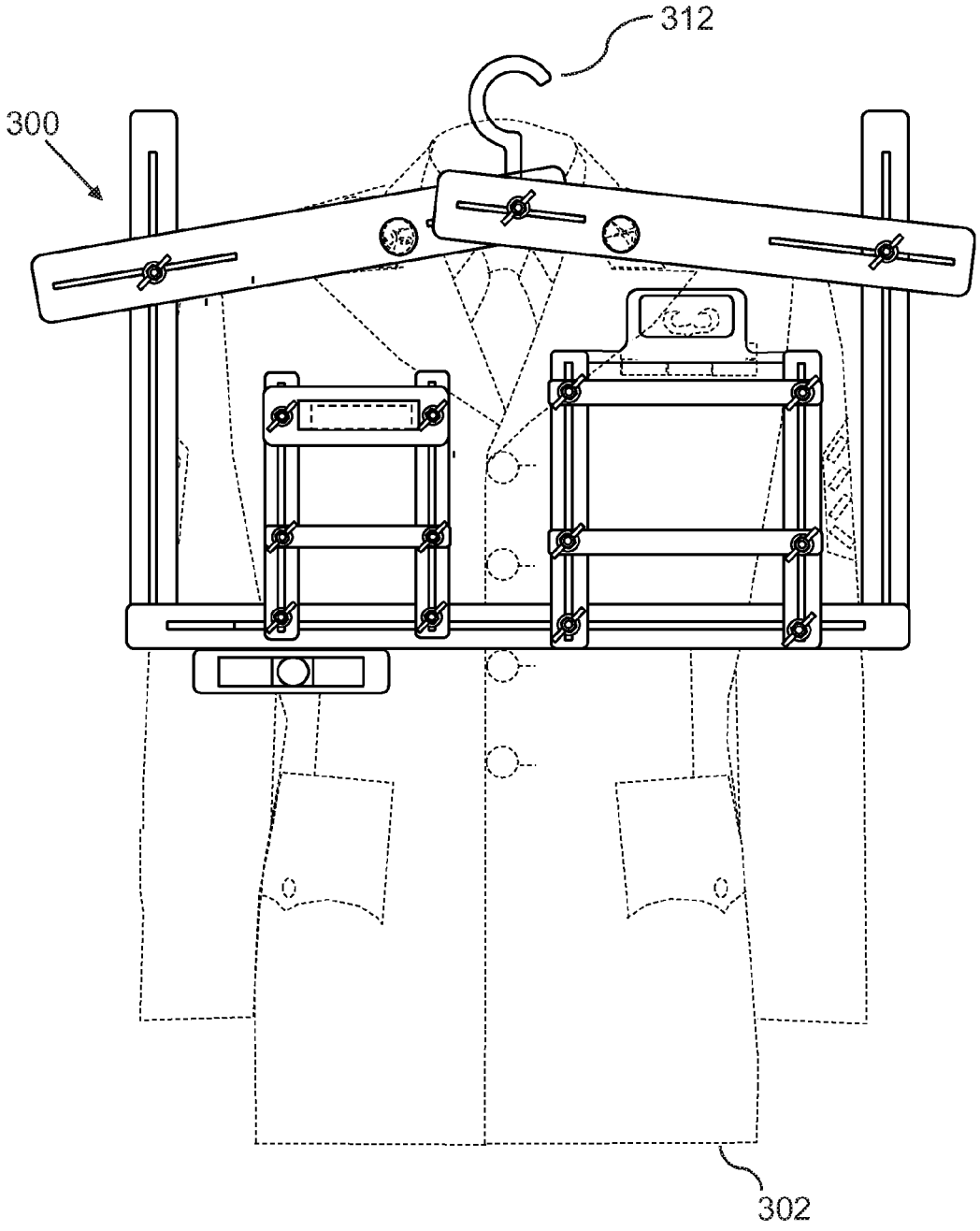
FIG. 3 is a front view of a uniform organizer installed on a uniform jacket, according to an embodiment of the invention.

In a related embodiment, such as shown in FIG. 3, a uniform organizer 300 can be mounted on a surface of a uniform jacket 302 or other garment, for example by hanging the uniform organizer 300 in front of a jacket 302 that is hanging on a garment holder, such that the uniform organizer 300 is hanging in the frame hook 312.

In a further related embodiment, the uniform organizer 100 can be pinned onto a uniform jacket 302, or attached to the uniform jacket in some other manner, in order to allow careful positioning of insignia, ribbons, and other accoutrements. The uniform can also be laid out on a table or floor, with the uniform organizer 100 positioned on top of the uniform jacket 302.

In a related embodiment, the vertical strips 174 176 of the badge plate guide 170 can be spaced with a distance such as to be located on each side of the pocket of a jacket on which the uniform organizer 100 is placed. This can set the appropriate space between ribbons and the like for placement on the uniform.

In a related embodiment, there can be a cutout for an occupational badge on the spacer 178 that applies to the particular service member, wherein the cutout area indicates the placement of the occupational badge on the uniform.

In a related embodiment, the right and left upper frame sections 120 130 can be comprised of two metal bars that are configured to expand and retract, such that the right and left upper frame sections 120 130 can be lined up on the seam of the collar of a jacket.

In a related embodiment, each of the right and left upper frame sections 120 130 can include at least one cutout to indicate placement for the various insignias of the military branches. The shape and size of such cutouts can vary according to the type of insignia.

In a further related embodiment, the uniform organizer can be made in different sizes and configurations, according to the branch of military service for which it will be used.

In an embodiment, for which an example is shown in FIG. 2, a uniform organizer 200 for indicating correct placement of insignia and badges on a uniform, can include:

a. an organizer frame 210, which can further include:
   i. an upper frame section 215, which for example can be comprised of right and left upper frame section 120 130; such that the upper frame section 215 is connected with
   ii. a bottom section 250;
b. a name plate guide 160 260, which is horizontally slidably attached to the bottom section 250, such that the name plate guide further comprises:
   i. a name cutout 262, which indicates the correct placement of a name tag on the uniform 302.

In a related embodiment, the uniform organizer 200 can further comprise:

a. a right collar marker 226, which is an aperture in a right part of the upper frame section;
b. a left collar marker 236, which is an aperture in a left part of the upper frame section;
wherein the upper frame section 215 is configured to adjust locations of the right and the left collar markers, for example by adjusting a position of the right and left upper frame section 220 230.

In another related embodiment, the uniform organizer 200 can further comprise a badge plate guide 270, which is vertically slidably and horizontally slidably connected to the bottom section, the badge plate guide further comprising:

a. a badge cutout 272, configured such that the badge cutout 272 indicates a correct placement of a badge on the uniform.

In another related embodiment, the uniform organizer 200 can further be configured such that the badge plate guide 270 further comprises at least one spacer 178, which is vertically slidably connected to the badge plate guide 270, whereby the spacer is positioned to indicate correct placement of ribbons and badges.

In another related embodiment, the uniform organizer 200 can further be configured such that the name plate guide 260 is configured to be vertically slidably and horizontally slidably connected to the bottom section, the badge plate guide further comprising:

a. a name plate piece 261, comprising the name cutout 262, configured such that the name cutout 262 indicates a correct placement of a name plate on the uniform 302.

In another related embodiment, the uniform organizer 200 can further be configured such that the name plate guide 260 further comprises at least one spacer 268, which is vertically slidably connected to the name plate guide, whereby the spacer is positioned to indicate correct placement of ribbons and badges.

Here has thus been described a multitude of embodiments of the uniform organizer, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A uniform organizer for indicating correct placement of insignia and badges on a uniform, comprising:

a) an organizer frame, further comprising:
   i) a right upper frame section, which is an elongated piece, further comprising:
      a right inner slit, which is an elongated aperture in an inner end of the right upper frame section;
      a right outer slit; which is an elongated aperture in an outer end of the right upper frame section;
   ii) a left upper frame section, which is an elongated piece, further comprising:
      a left inner slit; which is an elongated aperture in an inner end of the left upper frame section;
      a left outer slit; which is an elongated aperture in an outer end of the left upper frame section;
   such that the right and left upper frame sections are slidably and rotationally attached, and secured in a selected position, with a top fastening mechanism connected through the right and left inner slits;
   iii) a right side section, which is an elongated piece, further comprising:
      a right side slit, which is an elongated aperture along a central part of the right side section;
      wherein the right side section is slidably and rotationally attached to the right upper frame section, and secured in a selected position, with a right side fastening mechanism inserted through the right outer slit and the right side slit;
   iv) a left side section, which is an elongated piece, further including:
      a left side slit, which is an elongated aperture along a central part of the left side section;
      wherein the left side section is slidably and rotationally attached to the left upper frame section, and secured in a selected position, with a left side fastening mechanism inserted through the left outer slit and the left side slit;
   v) a bottom section, which is an elongated piece with straight edges, such that a right end of the bottom section is perpendicularly connected to a lower end of the right side section, and such that a left end of the bottom section is perpendicularly connected to a lower end of the left side section, such that the bottom section further comprises:

a bottom slit, which is an elongated aperture along a central part of the bottom section;

b) a name plate guide, which is horizontally slidably attached to the bottom section, such that the name plate guide further comprises:

i) a name cutout, which indicates the correct placement of a name tag on the uniform.

2. The uniform organizer of claim 1, further comprising:

a) a frame hook, further comprising:

i) a mounting hole in a lower end of the frame hook; such that the right upper frame section is slidably and rotationally attached to the frame hook with the top fastening mechanism connected through a frame hook mounting hole and the right and left inner slits.

3. The uniform organizer of claim 1, further comprising:

a) a right collar marker, which is a circular aperture in a central part of the right upper frame section;

b) a left collar marker, which is a circular aperture in a central part of the left upper frame section.

4. The uniform organizer of claim 1, further comprising: a badge plate guide, which is vertically slidably and horizontally slidably connected to the bottom section, the badge plate guide further comprising:

a) a badge plate piece, including a badge cutout, configured such that the badge cutout indicates a correct placement of a badge on the uniform.

5. The uniform organizer of claim 4, wherein the badge plate guide further comprises:

a) a right vertical strip, comprising a right vertical slit; and b) a left vertical strip, comprising a left vertical slit;

wherein upper ends of the right and left vertical strips are connected to respectively right and left sides of the badge plate piece, such that the right and left vertical strips protrude vertically downward;

wherein the right and left vertical strips are vertically slidably and horizontally slidably connected to the bottom section with right and left plate guide fastening mechanisms connected through respectively the right and left vertical slits, and the bottom slit.

6. The uniform organizer of claim 5, further comprising at least one spacer, comprising right and left spacer apertures, wherein the spacer is vertically slidably connected between the right and left vertical strips, such that the spacer is perpendicular to the right and left vertical strips, such that the spacer is secured in place with spacer fastening mechanisms connected through the right and left spacer apertures and respectively the right and left vertical slits, whereby the spacer is positioned to indicate correct placement of ribbons and badges.

7. The uniform organizer of claim 1, further comprising a leveling device, which is connected to the organizer frame.

8. The uniform organizer of claim 7, wherein the leveling device is a bubble level, which is connected to a lower edge of the bottom section of the organizer frame.

9. The uniform organizer of claim 1, wherein the right and left upper frame sections, the right and left side sections, and the bottom section are made of elongated metal strips.

10. The uniform organizer of claim 1, wherein the name plate guide is horizontally slidably attached to a left side of the bottom section with a name plate fastening mechanism inserted through a name plate aperture and the bottom slit.

11. The uniform organizer of claim 1, wherein the name plate guide is configured to be vertically slidably and horizontally slidably connected to the bottom section, the badge plate guide further comprising:

a) a name plate piece, comprising the name cutout, configured such that the name cutout indicates a correct placement of a name plate on the uniform.

12. The uniform organizer of claim 11, wherein the name plate guide further comprises:

a) a right vertical strip, comprising a right vertical slit; and b) a left vertical strip, comprising a left vertical slit;

wherein upper ends of the right and left vertical strips are connected to respectively right and left sides of the name plate piece, with right and left plate piece fastening mechanisms, connected through right and left name plate apertures, and respectively the right and left vertical slits, such that the right and left vertical strips protrude vertically downward;

wherein the right and left vertical strips are vertically slidably and horizontally slidably connected to the bottom section with right and left name guide fastening mechanisms connected through respectively the right and left vertical slits, and the bottom slit.

13. The uniform organizer of claim 12, further comprising at least one spacer, comprising right and left spacer apertures, wherein the spacer is vertically slidably connected between the right and left vertical strips, such that the spacer is perpendicular to the right and left vertical strips, such that the spacer is secured in place with spacer fastening mechanisms connected through the right and left spacer apertures and respectively the right and left vertical slits, whereby the spacer is positioned to indicate correct placement of ribbons and badges.

14. The uniform organizer of claim 5, wherein the badge plate guide is configured such that upper ends of the right and left vertical strips are vertically slidably connected to respectively right and left sides of the badge plate piece with right and left plate piece fastening mechanisms, connected through right and left badge plate apertures, and respectively the right and left vertical slits.

15. The uniform organizer of claim 1, wherein the bottom section is vertically slidably and horizontally slidably connected to the right and left side sections with right and left name guide fastening mechanisms, connected through respectively the right and left side slits and the bottom slit.

16. A uniform organizer for indicating correct placement of insignia and badges on a uniform, comprising:

a) an organizer frame, further comprising:

i) an upper frame section; connected with ii) a bottom section;

b) a name plate guide, which is horizontally slidably attached to the bottom section, such that the name plate guide further comprises:

i) a name cutout, which indicates the correct placement of a name tag on the uniform.

17. The uniform organizer of claim 16, further comprising:

a) a right collar marker, which is an aperture in a right part of the upper frame section;

b) a left collar marker, which is an aperture in a left part of the upper frame section;

wherein the upper frame section is configured to adjust locations of the right and the left collar markers.

18. The uniform organizer of claim 16, further comprising a badge plate guide, which is vertically slidably and horizontally slidably connected to the bottom section, the badge plate guide further comprising:

a badge cutout, configured such that the badge cutout indicates a correct placement of a badge on the uniform.

19. The uniform organizer of claim 18, wherein the badge plate guide further comprises at least one spacer, which is vertically slidably connected to the badge plate guide, whereby the spacer is positioned to indicate correct placement of ribbons and badges.

20. The uniform organizer of claim 16, wherein the name plate guide is configured to be vertically slidably and horizontally slidably connected to the bottom section, the badge plate guide further comprising:

a name plate piece, comprising the name cutout, configured such that the name cutout indicates a correct placement of a name plate on the uniform.

21. The uniform organizer of claim 20, wherein the name plate guide further comprises at least one spacer, which is vertically slidably connected to the name plate guide, whereby the spacer is positioned to indicate correct placement of ribbons and badges.

* * * * *